United States Patent [19]

Cooks et al.

[11] Patent Number: 4,536,652

[45] Date of Patent: Aug. 20, 1985

[54] HYBRID MASS SPECTROMETER

[75] Inventors: Graham Cooks, West Lafayette, Ind.; Michael S. Story, Los Gatos, Calif.; Gerhard Jung, Delmenhorst; Peter Dobberstein, Bremen, both of Fed. Rep. of Germany

[73] Assignee: Finnigan Mat GmbH, Fed. Rep. of Germany

[21] Appl. No.: 542,117

[22] Filed: Oct. 14, 1983

[30] Foreign Application Priority Data

Oct. 16, 1982 [DE] Fed. Rep. of Germany ..... 3238474

[51] Int. Cl.[3] ..... H01J 49/26

[52] U.S. Cl. ..... 250/281; 250/282

[58] Field of Search ..... 250/281, 282

[56] References Cited

U.S. PATENT DOCUMENTS 4,037,100 7/1977 Purser ..... 250/281

4,234,791 11/1980 Enke et al. ..... 250/281

OTHER PUBLICATIONS

Cooks et al., "Mass Spectrometry/Mass Spectrometry", *Chemical and Engineering News,* Nov. 30, 1981, pp. 40–52.

*Primary Examiner*—Alfred E. Smith
*Assistant Examiner*—Jack I. Berman
*Attorney, Agent, or Firm*—Flehr, Hohbach, Test, Albritton & Herbert

[57] ABSTRACT

In a hybrid mass spectrometer, a high-energy collision chamber (8) is arranged in a field-free region (12) which, in the direction of travel of the ions, is located after the first stage (1 to 6). A lens arrangement (9) serves for decelerating daughter ions of different energies to a fixed energy, and preferably at the same time also for shaping the ion beam. Preferably, the hybrid mass spectrometer is of BEQQ configuration.

11 Claims, 4 Drawing Figures

HYBRID MASS SPECTROMETER

DESCRIPTION

The invention relates to a hybrid mass spectrometer for the mas analysis of daughter ions, comprising an ion source, a first electric and/or magnetic stage, a device for breaking the ions into daughter ions, a lens arrangement and a second stage with at least one analyzer.

STATE OF THE ART

1. R. G. Cooks and G. L. Glish, Chemical and Engineering News, Nov. 30, 1981
2. R. A. Yost et al., Int. J. Mass Spectrom. Ion. Phys., 30, 1979, page 127
3. S. A. McLuckey, G. L. Glish and R. G. Cooks, Int. J. Mass Spectrom. Ion Phys., 39 1981, page 219
4. M. S. Kim and F. W. McLafferty, J. Am. Chem. Soc. 100, 1978, page 3279
5. E. Harting and F. H. Read, Electrostatic Lenses, Elsevier Scientific Publishing Co., 1976
6. G. L. Glish and P. J. Todd, Anal. Chem. 54, 1982, page 842
7. I. W. Griffiths et al., Int. J. Mass Spectrom. Ion Phys. 39, 1981, pages 125
8. G. J. Louter, A. J. H. Boerboom et al., Int. J. Mass Spectrom. Ion Phys., 33, 1982, page 335 et seq.
9. M. G. Gross et al., Intern. J. Mass Spectrom. Ion Phys., 42, 1982, page 243 et seq.
10. Company brochure of Messrs. Finnigan MAT GmbH "Model 8200-QQ, MS/MS System", August 1982.

The mass spectrometer of the type set forth above is known, for example, from the abovementioned printed publication 8.

Generally, hybrid mass spectrometers, also called tandem mass spectrometers or mass spectrometer/mass spectrometer (abbreviation: MS/MS), are used for obtaining additional information on the structure of molecules, including those present in complex mixtures, and for studying ion/molecule reactions. An MS/MS instrument comprises three main components: a first mass spectrometer or mass analyzer which produces a beam of so-called "parent ions", a so-called CID device (collision-induced dissociation device) which breaks the parent ions into fragments (so-called daughter ions), and a second analyzer which separates the daughter ions with respect to mass or energy.

Amongst a variety of MS/MS instruments, hybrid mass spectrometers have gained increasing importance in recent years. They combine various principles of mass (and energy) analysis, namely magnetic (B) and electric (E) sector fields and quadrupoles (Q). A preferred embodiment of the invention here relates to a hybrid mass spectrometer of BEQQ configuration, which means that a magnetic sector, an electric sector and two quadrupoles are arranged one behind the other. (Compare the sytems described under No. 1 and 10 of the above list of references.) The sections between the ion source and the magnetic sector, between the magnetic sector and the electric sector, and between the electric sector and the analyzer quadrupole are called the first, second and third field-free regions respectively.

The existing hybrid mass spectrometers of this configuration use high-energy CID devices for breaking the molecules only in the first and second field-free regions. In literature reference 2, a CID device is also arranged in the third field-free region, this device being a quadrupole operating in a broad ban filter mode. This device is, however, restricted to CID processes which occur at low energy levels, preferably 2 to 100 eV. The focussing property of the CID quadrupole is ineffective at high energies, because of the principal condition that the ions must pass through several high-frequency scans, in order to be well focussed.

In literature references 8 and 9, the high-energy collision chamber is built into a pure sector field instrument of EBE type. The disadvantage of this arrangement is the low resolution capacity for the daughter ions, which is only about 50. By contrast, the resolution capacity for the parent ions, that is to say upstream of the collision chamber, is fairly high and amounts to about 100,000.

To summarize briefly, the known systems of EBE or BEB type admittedly have high-energy collison chambers, but only a low resolution capacity for the daughter ions. The known systems of BEQQ type, for example according to literature reference 10, have a low-energy collision chamber with a high resolution capacity for the daughter ions. However, this low-energy collision chamber involves substantial restrictions, as compared with high-energy collision chambers, since a hybrid mass spectrometer with CID at higher energies provides additional information in the daughter ion spectrum (compare literature reference 3) and entails marked advantages in the case of molecules of higher molecular weight (compare literature reference 4). In addition, a high-energy collision chamber permits an effective charge exchange of negatively charged ions (compare literature reference 1).

It is therefore the object of the invention to improve a hybrid mass spectrometer of the type set forth above, in such a way that an improved efficiency coupled with high resolution capacity is obtained both for the daughter ions and the parent ions.

According to the invention, this object is achieved when a high-energy collision chamber is provided which is located in a field-free region which, in the direction of travel of the ions, is located after the first stage, and when the lens arrangement is used for decelerating daughter ions of different energies to a fixed energy.

In the invention, a high-energy collision chamber known per se is thus arranged in a field-free region which is located after the first stage of the mass spectrometer. (In the systems hitherto known, the high-energy collision chamber was always located within the first stage). If the invention is applied in a hybrid mass spectrometer of BEQQ type, the high-energy collision chamber is thus located in the third field-free region defined above. To ensure perfect transfer of the daughter ions, produced in the high-energy collision chamber, and also the parent ions to the quadrupole analyzer, a lens arrangement of electrostatic lenses is provided, which arrangement alters the ion energy. According to a further development of the invention, this lens arrangement is additionally also used for forming the ion beam cross-section.

The present invention is based on the consideration that molecules of high mass number, that is to say large molecules, are difficult to decompose into their fragments, if they have low kinetic energies. With the high-energy collision chamber of the invention, the energy of the molecules, before they are broken into daughter ions, remains in the keV range, so that the breaking is improved and further reaction mechanisms can be investigated.

Advantageous embodiments and further developments of the invention are to be found in the sub-claims. The high-energy collision chamber with a needle, mentioned in claim 12, is described in literature reference 6. This is also well suited to the purposes of the present invention. The use of a laser beam in place of the high-energy collision chamber is described in literature reference 7.

Generally, the CID device of the invention operates at very high ion energies which lie between about 3 and 10 keV.

The energy of the daughter ions $E_i$ is related to the energy of the parent ions $E_O$ in accordance with the following equation:

$$E_i = E_0 \cdot \frac{m_d}{m_p}$$

where $m_p$ is the mass of the parent ions and $m_d$ is the mass of the daughter ions. Since the quadrupole mass filter which analyzes the daughter ions operates at low and nearly constant ion energies of typically 5 to 20 eV, a special lens arrangement is used to decelerate the ions to an energy which is appropriate for the mode of operation of the quadrupole analyzer, the ion beam additionally being changed from a substantially rectangular cross-section of normally 0.2 to 0.02 mm width and 3 to 10 mm height at the exit slit of the first analyzer to a subtantially circular cross-section of about 3 to 8 mm diameter at the entrance of the quadrupole analyzer.

Below, the invention is explained in detail by reference to an illustrative embodiment in conjunction with the drawing in which.

Figure 1:
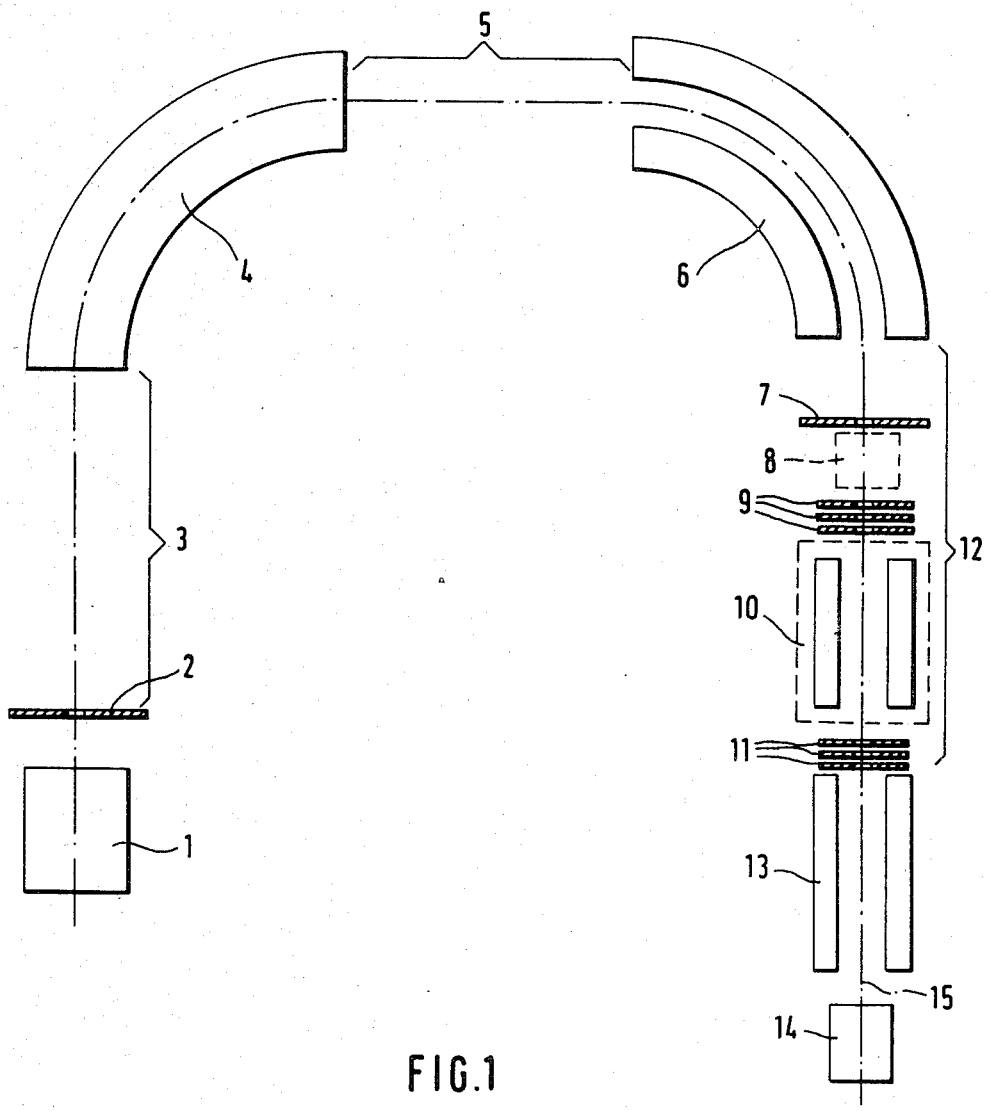
FIG. 1 is a diagrammatic representation of a hybrid mass spectrometer of BEQQ configuration, in which the invention is employed.

FIG. 1 shows a hybrid mass spectrometer of BEQQ configuration. From an ion source 1, the ions pass through an inlet slit 2 into a first field-free region 3 and from there via a magnetic sector 4 and a second field-free region 5 to an electric sector 6 and an exit slit 7. So far, this is a conventional double-focussing mass spectrometer of reverse geometry (BE). After leaving the exit slit 7, the ions pass into a high-energy collision chamber 8 which is located in a third field-free region 12 after the exit slit 7. The energy of these ions (parent ions) entering the high-energy collision chamber 8 is essentially equal to the acceleration voltage of the first stage, which is of the order of magnitude of 3 keV to 10 keV. It may differ from this, but is still within the keV range. The energy of the daughter ions leaving the high-energy collision chamber 8 can be determined by means of the relationship given above, from which it follows that it has a scatter over a relatively wide range.

The ions leaving the high-energy collision chamber 8 pass to a lens arrangement 9, the configuration of which will be described in more detail in connection with FIGS. 2 to 4. This lens arrangement serves two purposes: on the one hand, it decelerates the parent ions and all the daughter ions of different energies to a constant energy at the entrance of a downstream CID device 10. This is done by synchronous variation of the voltage applied to the lens arrangement during one scan of the quadrupole analyzer 13. It should be pointed out that, in the present invention, the low-energy CID device 10 is not filled with collision gas, so that it transfers the ions to the quadrupole analyzer 13 without further interactions. The second purpose of the lens arrangement 9 is to shape the ion beam from a rectangular cross-section at the exit slit to a substantially circular cross-section in the downstream quadrupoles 10 and 13.

After leaving the lens arrangement 9, the ion beam passes into the said low-energy CID device 10 and from there via a further lens arrangement 11 into the quardupole analyzer 13 and from there finally into a detector 14. The ion path is indicated by the broken line 15.

The operation of the low-energy CID device 10 and of the quadrupole analyzer 13 (quadrupole mass filter) essentially corresponds to that of the last two sections of a tandem quadrupole mass spectrometer (compare literature reference 2).

Figure 2:
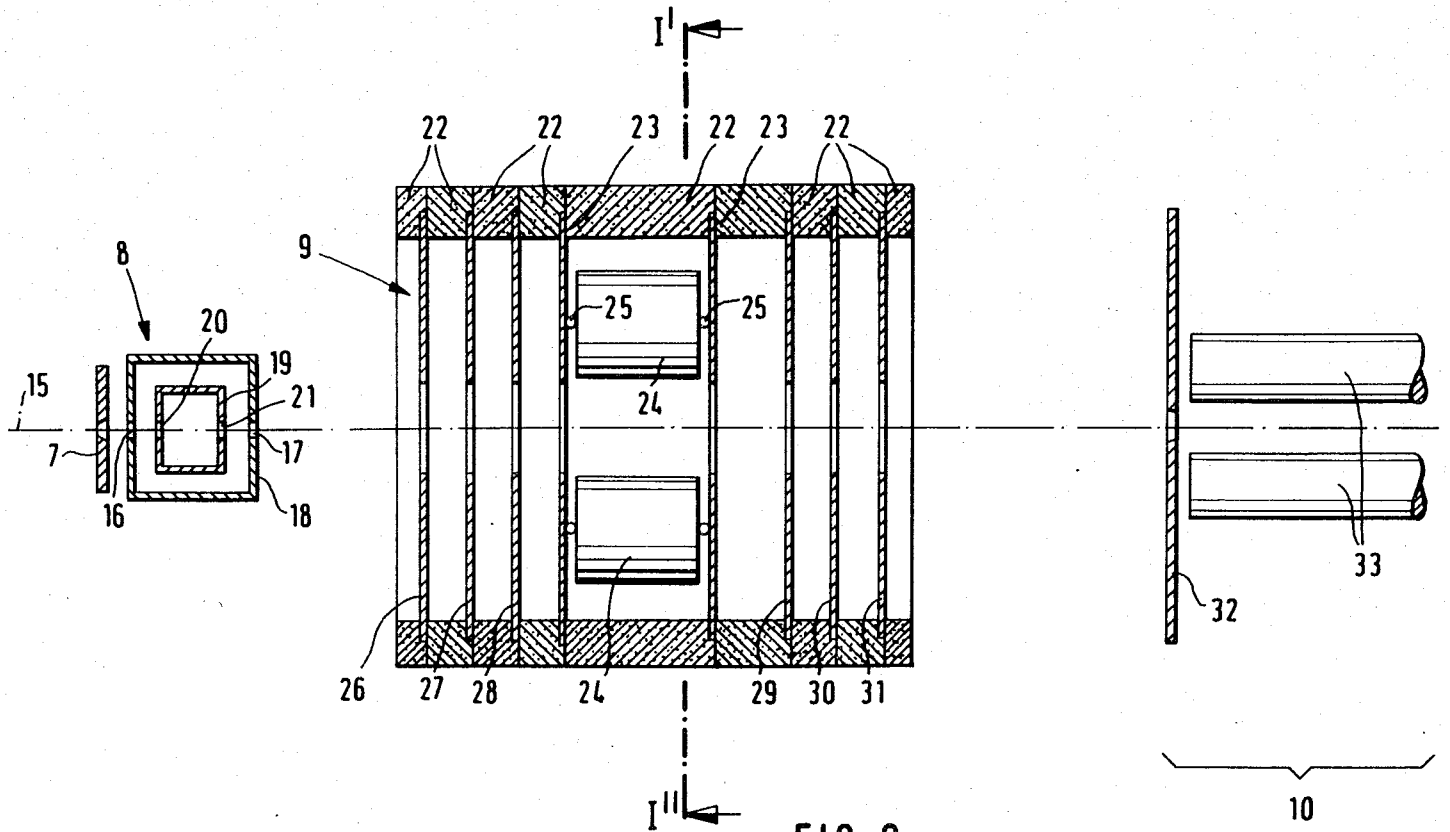
FIG. 2 is a simplified view of a part of FIG. 1, for illustrating an embodiment of the invention.

FIG. 2 shows an enlarged illustration of the exit slit 7, the high-energy collision chamber 8, the lens arrangement 9 and a portion of the low-energy CID device 10. The same reference symbols as in FIG. 1 designate the same components. After the ion beam has passed the exit slit 7 on the ion path 15, it reaches the high-energy collision chamber 8 which comprises two interpenetrating casings 18 and 19. The two casing 18 and 19 each have an inlet aperature 16 or 20 and an outlet aperture 17 or 21 respectively. All these apertures are exactly aligned. The apertures 20 and 21 of the inner casing 19 have a height of 3 mm and a width of 0.5 mm. The inlet aperture 16 of the outer casing 18 is 3 mm high and 0.5 mm wide, whilst the exit aperture 17 of the outer casing 18 is 3 mm high and 1 mm wide.

The inner casing 19 is filled with a collision gas such as, for example, argon, which is maintained at a pressure of approximately 0.1 mbar by means of pumps which are not shown. The outer casing 18 is evacuated by a high-vacuum pump (likewise not shown) which has a pumping capacity of approximately 40 liters/second. This pump evacuates the outer casing 18 to a pressure of about $10^{-3}$ mbar. Both the casings are preferably made of stainless steel. The charging line (not shown in FIG. 2 for the sake of clarity) of the high-energy collision chamber 8 is evacuated by means of a high-vacuum pump (not shown) of a capacity of about 200 liters/-second, which results in a pressure of about $3\times10^{-6}$ mbar in the region outside the collision chamber.

In place of a high-energy collision chamber of this type, other known high-energy collision chambers can also be used, for example the high-energy collision chamber with a needle, as described in literature reference 6.

The lens arrangement 9, serving the purposes described above, is constructed as follows. A first "single" lens with the individual elements 26, 27 and 28 is followed by a quadrupole lens with quadrupole rods or electrodes 24 and then a second "single" lens with the individual elements 29, 30 and 31. All the lens elements 26 to 31 as well as mounting elements 23 of similar shape on either side of the quadrupole rods 24, have a central circular hole of a diameter of about 15 mm. The individual elements are preferably made of 1 mm thick stainless steel plates which are held by insulating rings 22. These rings are preferably made of a plastic such as, for example, Lexan. The four quadrupole rods 24 are kept insulated from the mounting elements 23 by means of sapphire balls 25. After the passage through the lens arrangement 9, the ions pass through an inlet aperture 32 to the CID device 10 which has quadrupole rods 33.

The first "single" lens (elements 26, 27 and 28) has the function of an electrostatic zoom lens, that is to say it decelerates or accelerates the parent ions and the daughter ions produced in the high-energy collision chamber to a fixed ion energy at the inlet of the quadrupole, that is to say the CID device 10. This energy is typically 200 V. Different voltages are applied to the individual element in the "single" lenses, as shown in Table 1 which follows. Representative values of the parent and daughter ion energies are also listed in the Table.

Column 1 of Table 1 contains the daughter ion mass/parent ion mass ratio. The Table shows only some discrete values; intermediate values can be obtained by interpolation. Column 2 indicates the ion type, that is to say parent ions or daughter ions.

Column 3 shows the energy of the parent or daughter ions at the inlet to the lens arrangement. The values have been calculated in accordance with the equation given above, on the assumption that the energy of the parent ions is about 3,000 eV. Columns 4 to 9 show the potentials or electric voltages of the individual elements 26, 27, 28, 29, 30 and 31 of FIG. 2, relative to ground. These potentials have been calculated from the tables given in literature reference 5. Only the voltage U (27), that is to say the voltage on the element 27, is a more complicated function of the ion energy, which cannot be represented by an analytical expression, whilst the other potentials are simple functions of the ion energy, in accordance with the following equation:

$$U(L_n) = \frac{1}{e} E_i + U_n \quad n = 3 \ldots 6$$

where $U_3 = -214$ V $U_4 = -214$ V $U_5 = -360$ V $U_6 = -20$ V where $U(L_n)$ is the voltage applied to the corresponding element.

The quadrupole rods 24 have no influence on the ion energies; they only serve for shaping the ion beam.

The second "single" lens (elements 29, 30, 31) focusses the image produced by the first "single" lens and the quadrupole onto the inlet aperture of the low-energy CID device 10 and decelerates the ions from 200 eV to 20 eV. The voltage difference between the elements 29 to 31 is kept constant when a daughter ion spectrum is scanned, but the voltages relative to ground of all the elements, with the exception of the elements 26 and 27, are varied with a strictly linear voltage ramp which is proportional to the daughter ion mass. The same applies to the low-energy CID device 10 and the quadrupole mass analyzer 13.

As an alternative to the above procedure, it is possible to utilize the low-energy CID quadrupole and/or the potentials of the analyzer quadrupole relative to ground for a further deceleration. For example, it would be possible to use the lens system for a deceleration to 200 eV and to obtain the remaining 180 eV of deceleration, required for transmitting the ions at, for example, 20 eV, when a correspondingly high potential relative to ground is applied to these quadrupoles or when this potential difference exists between the two quadrupoles.

Figure 3:
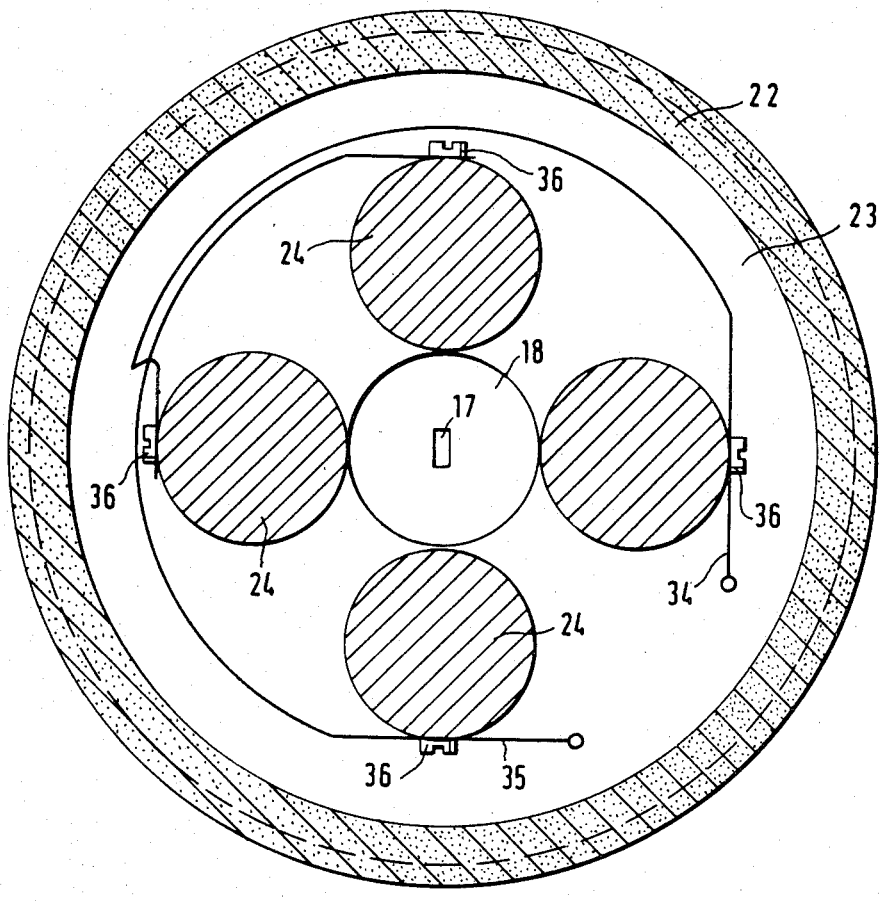
FIG. 3 is a simplified sectional view along the line I'-I'' in FIG. 2.

FIG. 3 shows a section along the line I'-I" of FIG. 2 Mutually opposite quadrupole rods are in each case electrically connected to one another via lines 34 and 35, each of these lines being connected via screws 36 to the associated quadrupole rod 24. For positive ions, a positive potential is applied to the line 35, whilst a negative potential relative to a mean potential is applied to the line 34, which mean potential is applied to the mounting element 23 and corresponds to the voltages U (28) of Table 1. For an ion energy of 200 eV, the potential difference between the lines 34 and 35 is typically about 40 V.

Figure 4:
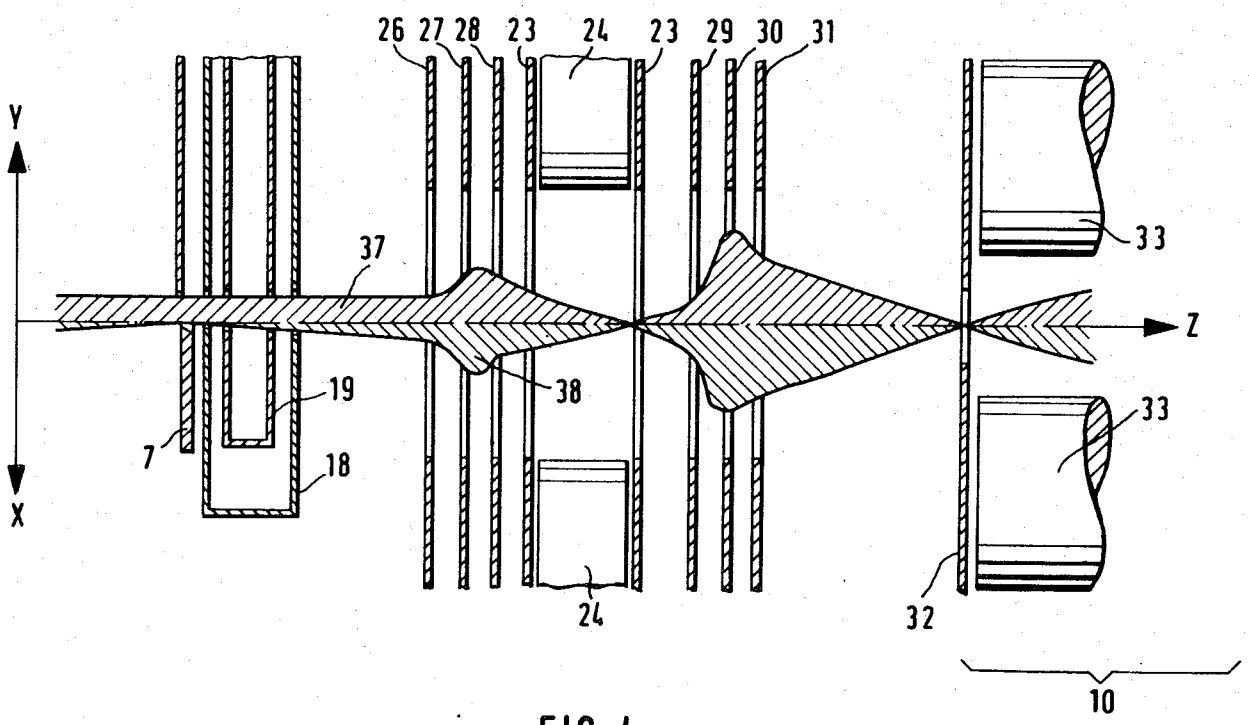
FIG. 4 is a simplified representation of that portion of FIG. 2, where the cross-section of the ion beam in the X-Z plane and Y-Z plane is shown, the illustration being enlarged in the x direction and the y direction (but not in the z direction) by a factor of 4.

FIG. 4 shows a view of the lens arrangement 9, enlarged in the y-z and x-z planes (but not in the z direction). The same reference symbols as in FIG. 1 to 3 here also designate the same components. The upper part of the drawing shows the y-z plane 37 which is parallel to the exit slit, whilst the lower part of the drawing shows the x-z plane 38 which is perpendicular to the exit slit. The influence of the lens arrangement on the ion beam can be seen from the hatched zones.

All the details represented in the claims, the description and the drawings can, both by themselves and in any possible combination with one another, be essential to the invention.

TABLE 1

| 1 $m_d/m_p$ | 2 Type | 3 $E_1$ (eV) | 4 U (26) (V) | 5 U (27) (V) | 6 U (28) (V) | 7 U (29) (V) | 8 U (30) (V) | 9 U (31) (V) |
|---|---|---|---|---|---|---|---|---|
| 1 | Parent | 3000 | 0 | 430 | 2786 | 2786 | 2640 | 2980 |
| 0.71 | Daughter | 2140 | 0 | −860 | 1926 | 1926 | 1780 | 2120 |
| 0.36 | " | 1070 | 0 | −2144 | 856 | 856 | 710 | 1050 |
| 0.14 | " | 428 | 0 | −2143 | 214 | 214 | 68 | 408 |
| 0.071 | " | 214 | 0 | −1498 | 0 | 0 | −146 | 194 |
| 0.035 | " | 107 | 0 | −1072 | −107 | −107 | −253 | 87 |
| 0.014 | " | 43 | 0 | −512 | −171 | −171 | −317 | 23 |
| 0.007 | " | 21 | 0 | −214 | −193 | −193 | −339 | 1 |
| 0.006 | " | 18 | 0 | −125 | −196 | −197 | −342 | −2 |

We claim:

1. A hybrid mass spectrometer for the mass analysis of daughter ions, comprising an ion source, a first electric and/or magnetic stage, a device for breaking the ions into daughter ions, a lens arrangement and a second stage with at least one analyzer, wherein a high-energy collision chamber (8) is provided, the high-energy collision chamber (8) is located in a field-free region (12) which, in the direction of travel of the ions, is located after the first stage (4, 6), and wherein the lens arrangement (9) is used for decelerating daughter ions of different energies to a fixed energy.

2. A hybrid mass spectrometer as claimed in claim 1, wherein the lens arrangement (9) is additionally also used for shaping the ion beam.

3. A hybrid mass spectrometer as claimed in claim 1 of BEQQ configuration (magnetic sector (B); electric sector (E); first quadrupole (Q)), having a first field-free region between the ion source and the magnetic sector, a second field-free region between the magnetic and electric sectors and a third field-free region between the electric sector and the first quadrupole, wherein the high-energy collision chamber (8) is located in the third field-free region (12).

4. A hybrid mass spectrometer as claimed in any of claims 1, 2 or 3, wherein the high-energy collision chamber (8) comprises two casings (18, 19) located within one another and having aligned entrance apertures (16; 20) and exit apertures (17, 21), the inner casing (19) being filled with collision gas and the outer casing (18) being evacuated.

5. A hybrid mass spectrometer as claimed in claim 4, wherein the pressure in the inner casing (19) is about 0.1 mbar, and the pressure in the outer casing is about $10^{-3}$ mbar.

6. A hybrid mass spectrometer as claimed in claim 5, wherein the pressure outside the high-energy collision chamber (8) is about $3\times10^{-6}$ mbar.

7. A hybrid mass spectrometer as claimed in any of claims 1, 2, or 3, wherein the first stage is of EB configuration, that is to say an electric sector (E) is followed by a magnetic sector (B).

8. A hybrid mass spectrometer as claimed in any of claims 1, 2, or 3, wherein the first stage contains only a magnetic sector (B).

9. A hybrid mass spectrometer as claimed in any of claims 1, 2, or 3, wherein the high-energy collision chamber (8) operates at an energy which corresponds to the energy of the first stage.

10. A hybrid mass spectrometer as claimed in any of claims 1, 2, or 3, wherein the high-energy collision chamber (8) operates at an energy which differs from the energy of the first stage.

11. A hybrid mass spectrometer as claimed in any of claims 1, or 2, wherein the mass spectrometer is of BEQ configuration (magnetic sector (B); electric sector (E); quadrupole (Q)).

* * * * *